US010966542B1

(12) United States Patent
Lauer-Listhaus

(10) Patent No.: US 10,966,542 B1
(45) Date of Patent: Apr. 6, 2021

(54) SEAT-DEPLOYED, VIRUS BODY-SHIELD

(71) Applicant: GermaGuard LLC, Livingston, NJ (US)

(72) Inventor: Barbara Lauer-Listhaus, Livingston, NJ (US)

(73) Assignee: GermaGuard LLC, Livingston, NJ (US)

( * ) Notice: Subject to any disclaimer, the term of this patent is extended or adjusted under 35 U.S.C. 154(b) by 0 days.

(21) Appl. No.: 16/928,160

(22) Filed: Jul. 14, 2020

(51) Int. Cl.
*A47C 31/02* (2006.01)
*A47C 31/11* (2006.01)

(52) U.S. Cl.
CPC ..... *A47C 31/113* (2013.01); *A47C 31/02* (2013.01)

(58) Field of Classification Search
CPC ..... A47C 31/113; A47C 31/02; A47C 31/10
USPC ..... 297/229
See application file for complete search history.

(56) References Cited

U.S. PATENT DOCUMENTS 6,447,059 B1 9/2002 Jackson et al.
7,481,491 B1 * 1/2009 Diamantis ..... A47C 7/021 297/223
8,156,975 B1 * 4/2012 Pickering ..... A47C 31/113 150/158
2002/0063455 A1 5/2002 Self
2006/0103185 A1 * 5/2006 Kahan ..... A47C 31/113 297/184.11
2007/0145798 A1 6/2007 Nadler-Sachs
2008/0305134 A1 * 12/2008 Lucas ..... A47C 31/105 424/403
2011/0078853 A1 * 4/2011 McCarthy ..... A47G 9/066 5/482
2012/0324646 A1 12/2012 Briganti
2012/0326475 A1 12/2012 Campbell
2015/0329031 A1 * 11/2015 Scott ..... B60N 2/6063 297/220
2016/0023582 A1 * 1/2016 Looper ..... B60N 2/6063 297/220
2016/0316931 A1 * 11/2016 Trevino ..... A47C 31/007
2018/0027987 A1 * 2/2018 Calhoun ..... A47C 7/622
2018/0064176 A1 * 3/2018 Brown ..... A47D 1/00
2018/0147963 A1 * 5/2018 Kim-Perek ..... B65D 88/22
2018/0201167 A1 * 7/2018 Yao ..... B60N 2/80
2019/0016243 A1 * 1/2019 Pancol ..... B60N 2/6063

OTHER PUBLICATIONS www.GermFreeBee.com Airplane Seat Cover & Blanket.
https://www.wicker.com/shop-by-brand/budge.

* cited by examiner

*Primary Examiner* — Mark R Wendell
(74) *Attorney, Agent, or Firm* — Mark S. Cohen; Pearl Cohen Zedek Latzer Baratz LLP

(57) ABSTRACT

An elastic virus-repellant, body-shield formed from a virus-repellant fabric for isolating people from surfaces of public seating. The body-shield is deployed through fitting and securing the shield to a public seat through the elastic nature of the shield and anchoring drawstrings until retrieved and packed into an attached carrying pouch. Certain embodiments include analogous supplementary shields for arm-rests, fold-down tables, leg-supplements, headrests, and other surfaces from which users need to be shielded.

11 Claims, 7 Drawing Sheets

SEAT-DEPLOYED, VIRUS BODY-SHIELD

BACKGROUND OF THE INVENTION

Situations in which public health is a primary concern, the public is encouraged to take cautionary measures to prevent the spread of infection. These measures usually take the form of wearing protective surgical masks, maintaining social distancing between people of at least two meters, and avoiding large gatherings. Avoiding large gatherings of people is particularly difficult for businesses that serve large groups of people and is also difficult for the public in need of their services. Therefore, there is a need to mitigate the risk of infection in public settings.

SUMMARY OF THE INVENTION

According to the teachings of the present invention there is provided, a seat-deployable, virus body-shield, the shield including a virus-repellant sheet of fabric; and one or more elastic bands embedded into the sheet of fabric along at least part of its perimeter.

According to a further feature of the present invention, the virus repellant sheet of fabric is implemented as a sheet of fabric coated with a virus repellant undercoating, the undercoating facing a chair when deployed.

According to a further feature of the present invention, the virus repellant coating is implemented as a hydrophobic coating.

According to a further feature of the present invention, the virus repellant sheet has protein-bonding inhibitor.

According to a further feature of the present invention, there is also provided, at least one drawstring anchored to the sheet of fabric.

According to a further feature of the present invention, a first drawstring of the least one drawstring is anchored in a segment of the sheet deployable on a seating portion of the chair and a second drawstring of the least one drawstring is anchored in a segment of the sheet deployable on a back portion of the chair.

According to a further feature of the present invention, the first drawstring borders three or more edges of the seating portion of the chair.

According to a further feature of the present invention, the second drawstring borders three or more edges of the back portion of the chair.

According to a further feature of the present invention, there is also provided a carrying pouch connected to the shielding sheet.

There is also provided according to the teachings of the present invention, a seat-deployable, virus body-shield, the shield including a virus-repellant sheet of elastic fabric; and at least one drawstring, a first drawstring of the at least one drawstring anchored in a segment of the sheet deployable on a seating portion of a chair, the first drawstring substantially parallel to at least a portion of a sheet perimeter.

According to a further feature of the present invention, the first drawstring arrangement configured to releasable secure the virus-repellant sheet onto the chair when the drawstring is secured in a taut state.

According to a further feature of the present invention, the virus repellant sheet of fabric is implemented as a sheet of fabric coated with a virus repellant undercoating, the undercoating facing a chair when deployed.

According to a further feature of the present invention, the virus repellant coating is implemented as a hydrophobic coating.

According to a further feature of the present invention, the virus repellant sheet has protein-bonding inhibitor.

According to a further feature of the present invention, there is also provided further comprising a caring pouch connected to the sheet of elastic fabric.

There is also provided according to the teachings of the present invention, a seat-deployable, virus body-shield kit including an elasticized, virus-repellant sheet of fabric; a first drawstring of the least one drawstring is anchored in a segment of the sheet deployable on a seating portion of the chair; and a second drawstring anchored in a segment of the sheet deployable on a back portion of the chair.

According to a further feature of the present invention, there is also provided, armrest shield supplements having a virus repellant undercoating.

According to a further feature of the present invention, there is also provided, fold down table shield having a virus repellant undercoating.

According to a further feature of the present invention, there is also provided, a carrying pouch connected to the elasticized, virus-repellant sheet of fabric.

BRIEF DESCRIPTION OF THE DRAWINGS

The subject matter regarded as the invention is particularly pointed out and distinctly claimed in the concluding portion of the specification. The invention components and their features, their interaction, method of operation, and advantages are set forth in the following detailed description and accompanying drawings in which:

It will be appreciated that elements shown in the figures are not necessarily drawn to scale.

DETAILED DESCRIPTION

In the following detailed description, specific details are set forth are set forth as examples to provide a thorough understanding of the invention. However, it will be understood by those skilled in the art that the present invention may be practiced without these specific details. Furthermore, well-known methods, procedures, and components have been omitted to highlight the inventive features.

The present invention is a seat-deployed, coronavirus body-shield for protecting people from infections transmitted from public seating like those found in airplanes, restaurants, stadiums, movie theaters, Broadway shows, concert halls, trains, bus seats, for example. The shield can be implemented in different sizes suitable for seat sizes. The entire shield and any supplementary shields can be loaded into a small carrying pouch, unloaded upon deployment and reloaded after use until washing.

Without diminishing in scope, public seating will be discussed in the context of an airplane seat; however, this is only an example of a common public seating arrangement.

Figure 1:
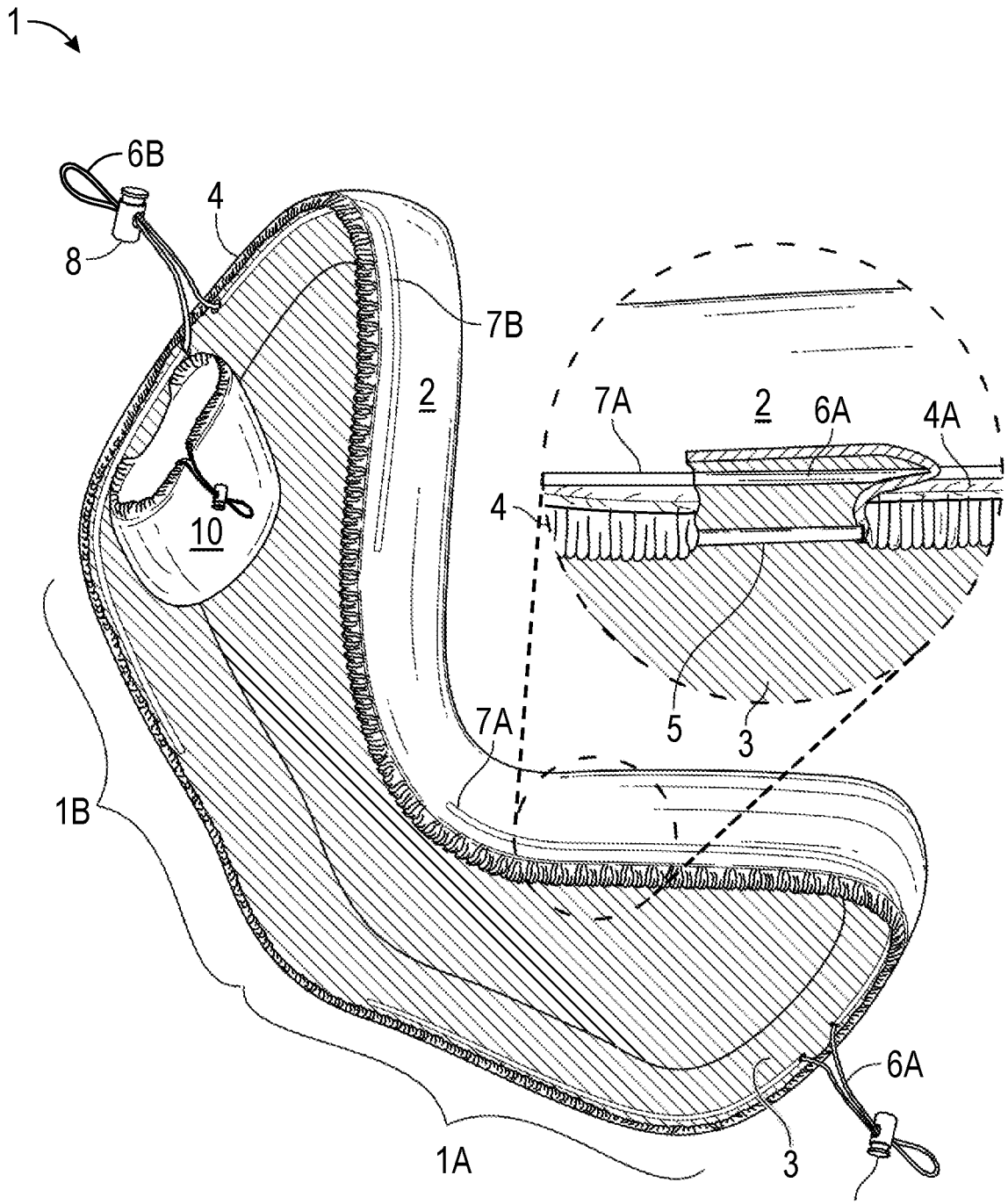
FIG. 1 is a perspective view of a primary body-shield for people seated in a chair, according to an embodiment.

Turning now to the figures, FIG. 1 is a depicts a primary body-shield 1 constructed of a fabric 2 coated with a virus repellant undercoating 3 for contact with a seating surface when deployed, according to a certain embodiment. As shown, shield 1 has an elasticized perimeter 4 formed from an elastic band 6 hemmed into hem 4A most clearly seen in the expanded view. Shield 1 also includes a drawstring 6A-6B embedded in channels 7A-7B, respectively, operative to secure shield 1 to a chair and effectively shield a user from contact with chair surfaces when drawstrings 6A-6B is secured in a taut state by clip 8, and an attached carry pouch 10 into which shield 1 is loaded after use, according to an embodiment.

Shield 1 is implemented in various dimension in accordance with chair dimensions to enable quick deployment and retrieval. Shield 1 is operative to shield users from primary chair surfaces like seating and back surfaces of either reclining or non-reclining chairs, and also surfaces of chair accessories like head rests, arm rests, and leg rests, depending on the embodiment, as will be further discussed.

In a certain embodiment, undercoating 3 is implemented as a coronavirus, SARS-CoV-2 repellant material like carbon, fiber polymer. In another variant embodiment, undercoating 3 is implemented as polytetrafluoroethylene nanoparticles, whereas in yet another variant embodiment, undercoating 3 is implemented as protein-bonding inhibitor or other materials providing such functionality.

In another certain embodiment, undercoating 3 contains nanoparticles of anti-viral and anti-bacterial metal ions and polymers. Nanoparticles based coatings advantageously provide a large surface area to volume ratio for an efficient anti-viral surface area using a relatively small amount of anti-viral metal that is toxic for viruses or bacteria; but, is non-toxic to people. Additionally, nanoparticles of anti-viral metal can be easily embedded in a polymer that can coat the relevant surfaces for extended periods of time to provide durable anti-viral coatings that can be sprayed or painted onto surfaces to prevent viral transmission. In In another variant embodiment, coating 3 is implemented as hydrophobic coatings employing nano-composite like oxide polystyrene (MnO2/PS), Zinc oxide polystyrene (ZnO/PS), precipitated calcium carbonate, carbon nano-tube structures, silica nano-coating, fluorinated silanes, and fluoropolymer coatings.

In certain other variant embodiments, coating 3 is implemented as silica-based hydrophobic coatings.

As noted above, shield 1 includes anchored circumferential drawstrings 6A and 6B embedded in channels 7A and 7B respectively, in a certain embodiment. As shown, drawstring 6B is anchored in the shield segment to be deployed on the chair back whereas drawstring 6A is anchored in the shield segment to be deployed on the seating. The two separate drawstrings advantageously enable a user to progressively secure each shield segment. This is especially useful in settings in which shield 1 needs to be deployed quickly like in an airplane setting in which people are waiting in the aisle while people settle into their assigned seats. As shown, both drawstrings 6A and 6B border or run parallel to the edges of three sides of upper shield segment 1A and lower shield segment 1B to secure shield 1 to three edges of a chair when the back edge of the seating portion and the bottom edge of the back of the chair are inaccessible; as is found in an airplane seat, for example. In certain other embodiments, drawstrings 6A and 6B border the entire perimeter of seating and back sections 1A and 1B, respectively. In yet another embodiment, only one drawstring is employed in either the seating or back shield segments 1A or 1B and will border only the front edge of a chair seat and the bottom edge of the chair back.

Figure 2:
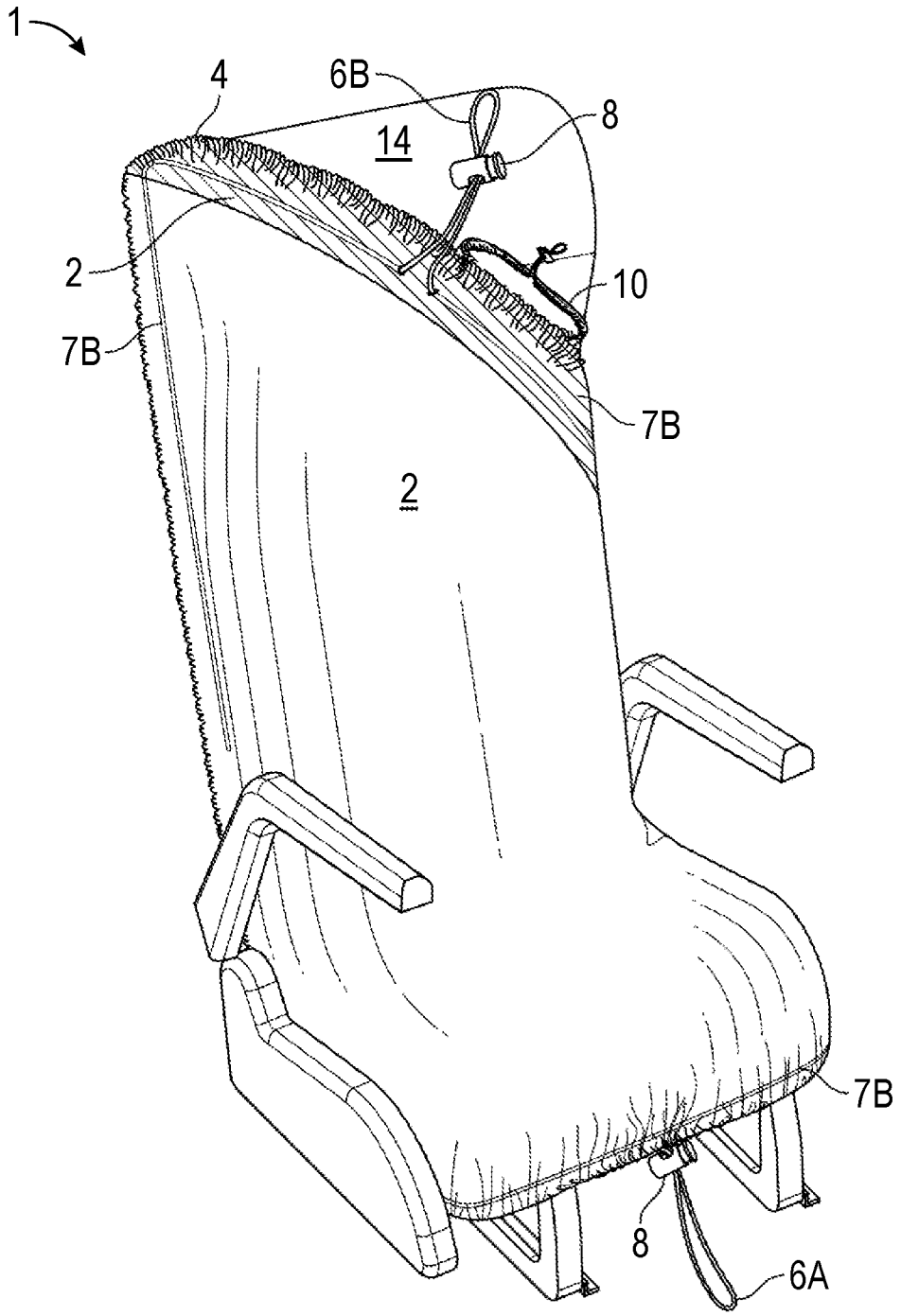
FIG. 2 is a perspective view of the body-shield of FIG. 1 during deployment on an airplane seat, according to an embodiment.

As shown, shield 1 includes a permanently attached carry pouch 10 into which shield 1 is carried and reloaded after use, in a certain embodiment. In another embodiment, carry pouch 10 is releasable attached through a zipper, snap, or VELCRO® connection. Carry pouch 10 is disposed on the upper edge of shield 1, to facilitate quick orientation of shield 1. Analogously, this placement also facilitates quick retrieval and packing of shield 1 into pouch 10. In other embodiments, pouch 10 is disposed along the bottom edge of segment 1B of shield FIG. 2 depicts deployment of body-shield 1 onto an airplane seat 14, according to an embodiment. During deployment, a user unpacks primary shield 1 from carrying pouch 10 onto seat 14. Elasticized perimeter 4 is placed around seat 14 with virus repellant surface 2 facing seat 14 to align and partially secure shield 1 to seat 14. Afterwards, drawstrings 6A and 6B are drawn taut and secured by clip 8. As shown, when drawstring 6A is drawn taut, it constricts the edge of the seating cushion of seat 14 to secure body-shield 1 and eliminate shield slippage from seat 14 during prolonged use to advantageously shield a user from contact with seat surfaces. In a certain variant embodiment, drawstrings 6A and 6B are drawn taut against each respective posterior surface of the seat portion and the back portion of airplane seat 14. In another variant embodiment, drawstrings 6A and 6B is are embedded in shield 1 so as to provide a user with options of drawing one string taut against one of the posterior surfaces of seat 14 and the other string taut against a cushion edge.

Figure 3:
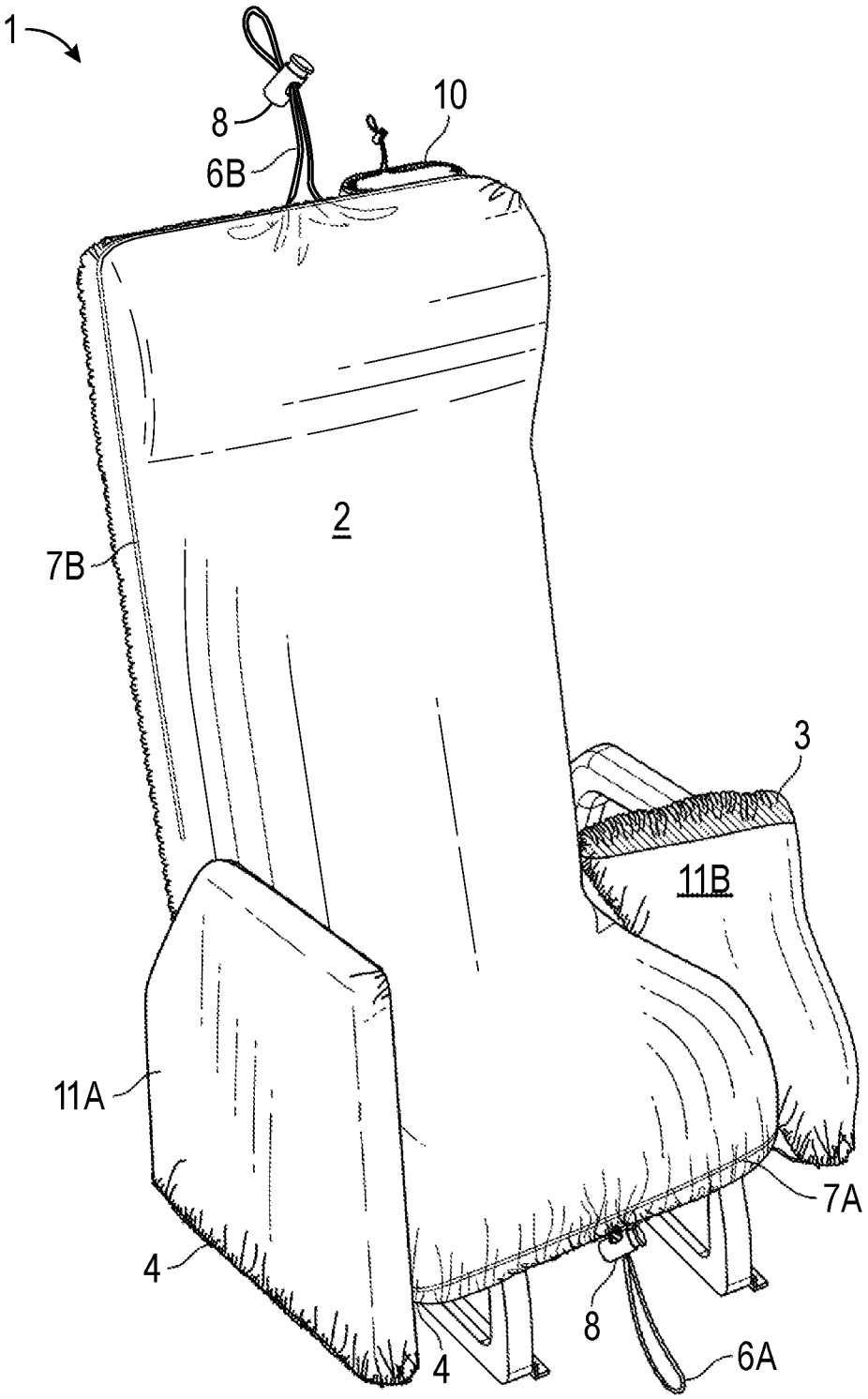
FIG. 3 is a perspective view of the body-shield of FIG. 1 and armrest supplement shields fully deployed on an airplane seat, according to an embodiment.

FIG. 3 depicts deployment of shield supplements 11A and 11B onto to armrests after full deployment of shield 1, according to an embodiment.

Armrest shield supplements 11A and 11B are also undercoated with a coronavirus repellant coating 3 most clearly visible in supplement 11B. In a certain embodiment, shield supplement have elasticized perimeters 4 to secure shield supplements to the armrests. In certain variant embodiments, supplements 11A and 11B isolate only armrest surfaces normally contacted by passengers sitting in seat 14. In a certain embodiment, supplements are permanently linked to shield 1 whereas in another variant embodiment supplements 11A and 11B releasably connect to primary shield 1 through VELCRO® connection, zipper or snaps.

Shield supplements are also implemented for leg rests. As noted, all shield supplements are implemented with the virus repellant undercoating, according to an embodiment. Furthermore, all shield supplements pack together with shield 1 into carrying pouch 10. All supplements together with shield 1 constitutes a virus, body-shielding kit that can easily be carried.

Figure 4:
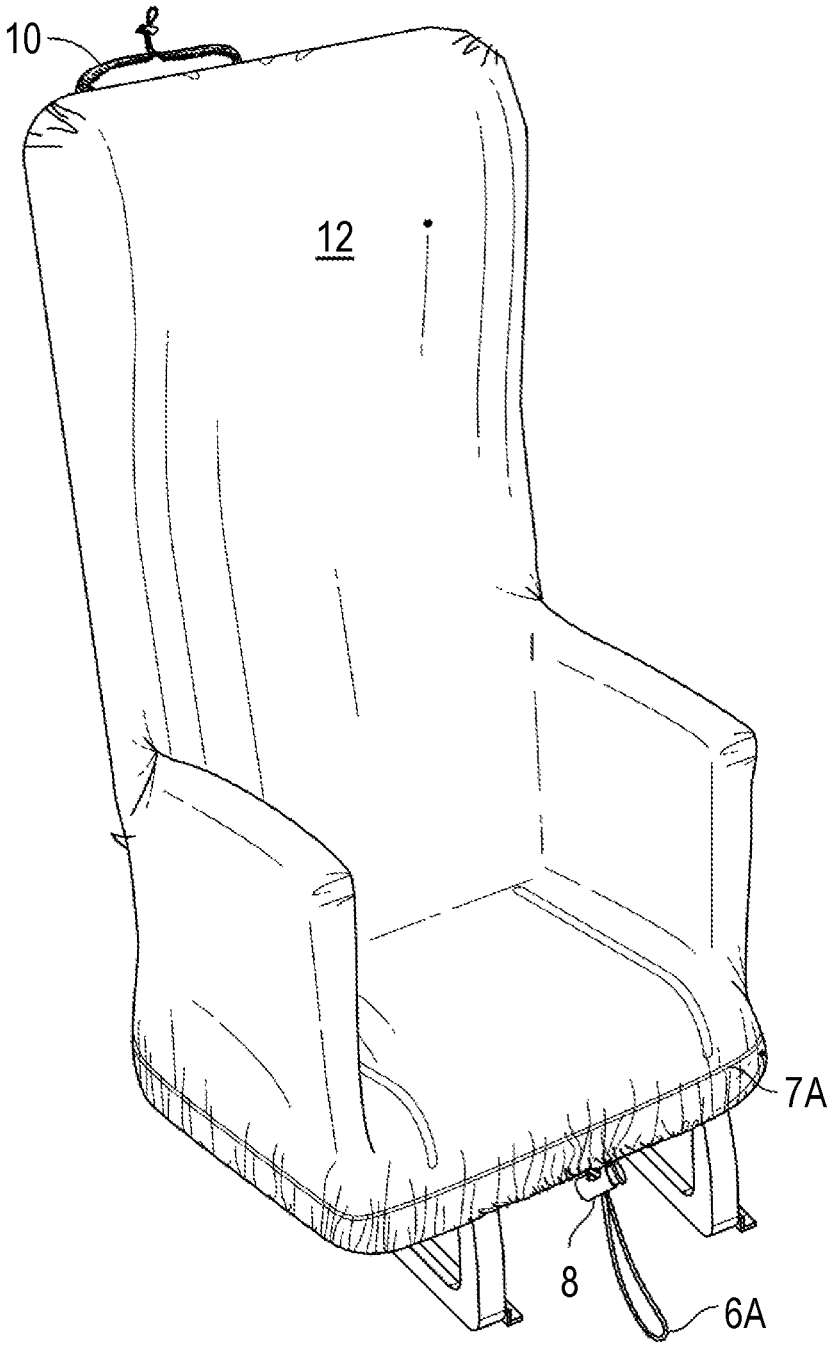
FIG. 4 is a perspective view of an elastic body-shield fully deployed on an airplane seat, according to an embodiment

FIG. 4 is a perspective view of an elastic body-shield 12 fully deployed on an airplane seat, according to an embodiment.

Elastic body-shield 12 is constructed of stretch fabric providing 4-directional stretch. In a certain embodiment elastic body-shield 12 is constructed from a polyether-polyurea copolymer like Spandex or Spandex blend with cotton. In another variant embodiment, elastic body-shield 12 is constructed from a blend of Spandex and polyester. In another variant embodiment, elastic body-shield 12 is constructed from a blend of Spandex and nylon. In another variant embodiment, elastic body-shield 12 is constructed from a blend of Spandex and rayon. In another variant embodiment, elastic body-shield 12 is constructed from a blend of Spandex and other synthetic materials. It should be noted that Spandex is also know, Lycra or elastane. In a certain embodiment elastic body-shield 12 is constructed from a knitted fabric.

In an embodiment, elastic body-shield 12 is formed to a seat by way of at least one anchored drawstring 6A bordering three sides of the seat portion as depicted by drawstring channel 7A. When drawstring is drawn taught, elastic body-shield 12 is drawn and held to chair geometry when constricting seat cushions along their edge or securing elastic body-shield 12 securing drawstring around posterior surfaces of the seat and the back portions of the seat. In certain embodiment, elastic body-shield 12 is formed recesses to fit over armrests.

Elastic body-shield 12 also includes a connected carrying pouch 10 into which the elastic body-shield 12 is loaded when deployed and reloaded after elastic body-shield 12 is retrieved. This embodiment also includes virus repellant, elastic body-shield supplements for a fold down table and associated latch shield as will be further discussed. In a variant embodiment, shield supplements are implemented with elasticized materials instead elastic material. All shield supplements and the shield form a coronavirus body-shielding kit as noted above.

Figure 5:
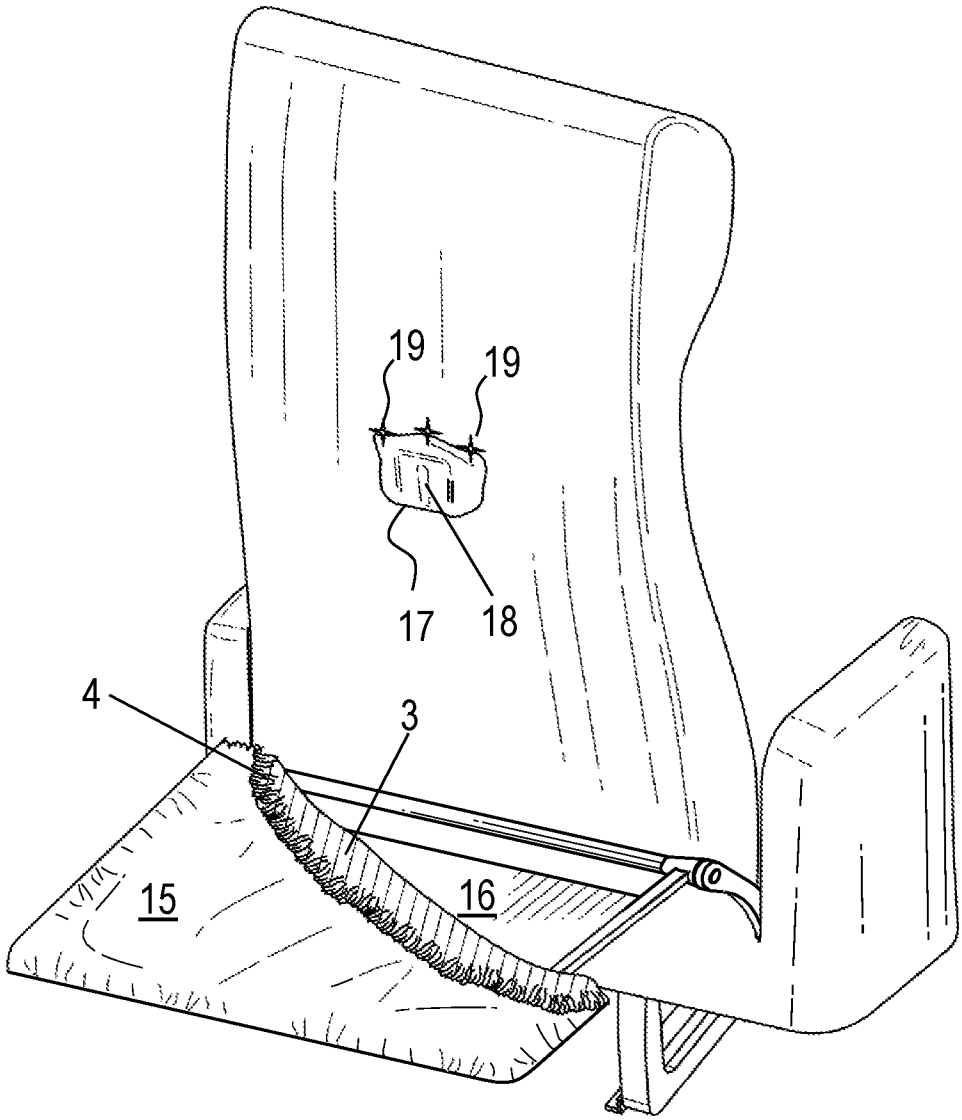
FIG. 5 is a perspective view of shield supplements during deployment onto a foldable airline tray and an airline tray latch while the tray is in an unfolded state, according to an embodiment.

FIG. 5 depicts embodiments of specialized shield supplements for covering additional virus and germ rich surfaces commonly encountered during airplane flights. Specifically, tray shield 15 is being deployed onto foldable airline tray 16 and tray latch shield 17 is deployed over tray latch 18, according to an embodiment. tray shield 15 is also equipped within an elasticized perimeter 4 and a virus replant undercovering 3, in a certain embodiment. Tray latch shield 17 also possess virus undercoating 3 (Visible in FIG. 3). As shown, tray latch shield 17 covers tray latch 18 and is secured to the back of the seat through connectors 19 that releasably engage the fabric of the seat disposed in front of the seat depicted in FIGS. 2-4. In a certain embodiment, tray latch connectors 19 are implemented as fasteners like hooks, clips, pins, or clasps or adhesive materials like VELCRO®, two-sided tape deployable on either the plastic surfaces surrounding the latch or the fabric surrounding the latch area. It should be appreciated that any of these connectors or other connectors providing such functionality are employed in the various embodiments and applications.

Figure 6:
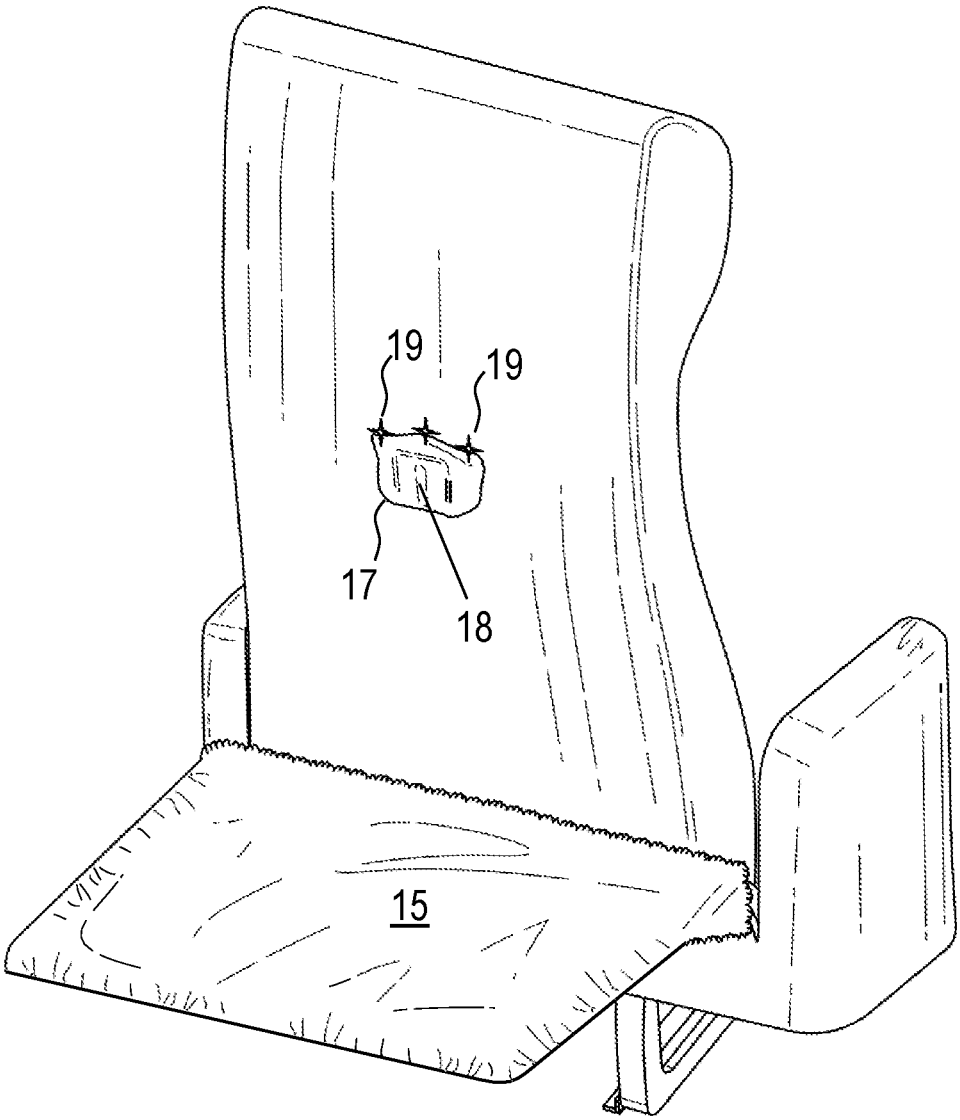
FIG. 6 is a perspective view of shield supplements fully deployed onto a foldable airline tray and an airline tray latch while the tray is in an unfolded state, according to an embodiment.

FIG. 6 depicts tray shield 15 and tray latch shield 17 fully deployed while tray 16 are in an unfolded state, according to an embodiment. As shown, the tray surface and tray latch surfaces are advantageously covered to further shield a traveler from infection.

Figure 7:
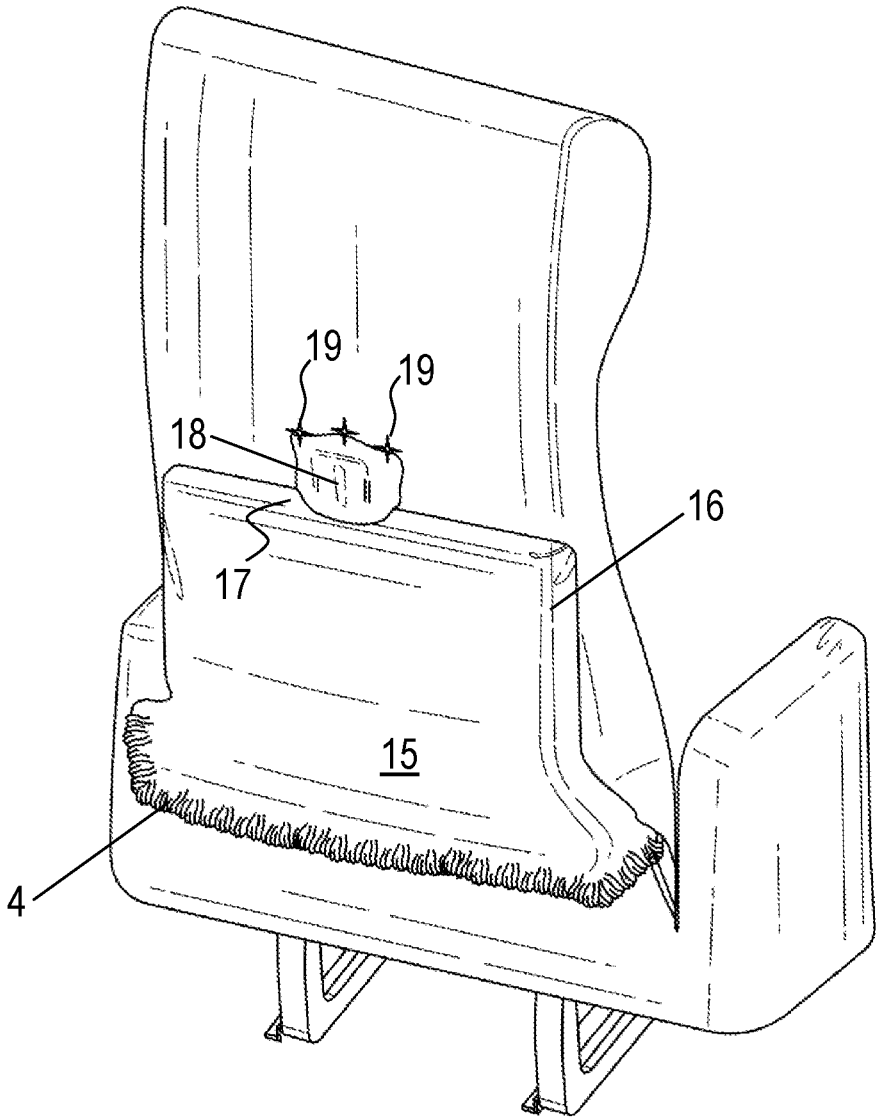
FIG. 7 is a perspective view of shield supplements fully deployed state while the tray is folded and latched, according to an embodiment.

FIG. 7 depicts tray shield 15 and tray latch shield 17 fully deployed while tray 16 is folded and latched to continue traveler shielding when tray 15 is not in use. In a certain embodiment, either one or both supplementary shields 15 and are implemented with a stretch fabric in the absence of the elasticized perimeter 4 as noted above.

After use, supplementary shields 15 and 17 are retrieved together with shield 1 and armrest shields 11A and 11B and packed in travel pouch 10. Primary shield 1, supplementary shields, 11A-11B, 15, 17 and carrying case 10 collectively form a shielding kit, as previously noted. In other embodiments, a kit is formed with other specialized supplementary shields together with primary shield 1 and its carrying case 10.

Additional viral, shielding embodiments are provided for booster seats, high chairs, car seats, strollers, bicycle saddles, massage tables, and swings. In these embodiments, the viral, body-shields are also coated with a virus repellent undercoating, stretch functionality either through elasticized perimeters or stretch fabric, and optionally, one or more drawstrings.

In another embodiment, viral body-shields are fitted with connectors corresponding to connectors also fitted on furniture or hardware to be isolated from the user during use. This connection arrangement advantageously enables each user to attach his personal viral body-shield during use and disconnect it and take his shield with him. Similarly, the next user attaches his shield to the same connectors during use and then removes his shield after use. Examples of connectors are snaps, hooks and clasps, VELCRO® connectors, and other connectors providing similar functionality.

It should be appreciated that embodiments formed from combinations of features set forth in separate embodiments are also included within the scope of the present invention.

While certain features of the invention have been illustrated and described herein, it should be understood that the appended claims are intended to cover modifications as fall within the true spirit of the invention.

What is claimed is:

1. A seat-deployable, virus body-shield, the shield comprising:

one virus-repellant sheet of fabric operative to cover both a seat portion and a back portion of a chair;

one or more elastic bands embedded into the sheet of fabric along at least part of its perimeter; and a plurality of drawstrings configured to secure the sheet onto the chair after deployment of the cover onto the chair, a first drawstring of the plurality of drawstrings configured to engage the seat portion when drawn taut and a second drawstring of the plurality of drawstrings configured to engage the back portion when drawn taut.

2. The body-shield of claim 1, wherein the virus repellant sheet of fabric is implemented as a sheet of fabric coated with a virus repellant undercoating, the undercoating facing a chair when deployed.

3. The body-shield of claim 2, wherein the virus repellant coating is implemented as a hydrophobic coating.

4. The body-shield of claim 2, wherein the virus repellant sheet has protein-bonding inhibitor.

5. The body-shield of claim 1, wherein the first drawstring borders three or more edges of the seat portion of the chair.

6. The body-shield of claim 1, wherein the second drawstring borders three or more edges of the back portion of the chair.

7. The body-shield of claim 1, further comprising a carrying pouch connected to the shielding sheet.

8. A seat-deployable, virus body-shield kit comprising:

one elasticized, virus-repellant sheet of fabric operative to cover both a seat portion and a back portion of a chair;

a first drawstring anchored in a segment of the sheet deployable on the seat portion of the chair; and a second drawstring anchored in a segment of the sheet deployable on the back portion of the chair.

9. The virus body-shield kit of claim 8 further comprising armrest shield supplements having a virus repellant undercoating.

10. The virus body-shield kit of claim 9 further comprising fold down table shield having a virus repellant undercoating.

11. The virus body-shield kit of claim 10 further comprising a carrying pouch connected to the elasticized, virus-repellant sheet of fabric.

* * * * *